US010486119B2

(12) United States Patent
Fiastre et al.

(10) Patent No.: US 10,486,119 B2
(45) Date of Patent: Nov. 26, 2019

(54) SYSTEM FOR PREPARING A FORMULATION

(71) Applicant: PROVAINE, Toulon (FR)

(72) Inventors: Olivier Fiastre, Aubagne (FR); Damien Blanchy, Fuveau (FR)

(73) Assignee: PROVAINE, Toulon (FR)

( * ) Notice: Subject to any disclaimer, the term of this patent is extended or adjusted under 35 U.S.C. 154(b) by 153 days.

(21) Appl. No.: 15/742,243

(22) PCT Filed: Jun. 30, 2016

(86) PCT No.: PCT/FR2016/051628
§ 371 (c)(1),
(2) Date: Jan. 5, 2018

(87) PCT Pub. No.: WO2017/006018
PCT Pub. Date: Jan. 12, 2017

(65) Prior Publication Data

US 2018/0200684 A1 Jul. 19, 2018

(30) Foreign Application Priority Data

Jul. 6, 2015 (FR) ..... 15 56405

(51) Int. Cl.
*B01F 9/10* (2006.01)
*B01F 11/00* (2006.01)
(Continued)

(52) U.S. Cl.
CPC ..... *B01F 9/10* (2013.01); *B01F 7/0095* (2013.01); *B01F 11/0025* (2013.01);
(Continued)

(58) Field of Classification Search
CPC ..... B01F 11/0054; B01F 11/0082; B01F 13/0818; B01F 13/1055; B01F 13/1063;
(Continued)

(56) References Cited

U.S. PATENT DOCUMENTS 1,267,562 A * 5/1918 Lindsay ..... B06B 1/167 74/87
2,804,777 A * 9/1957 Kerr-Lawson ..... B01F 11/0025 74/42
(Continued)

FOREIGN PATENT DOCUMENTS

FR 2 109 370 A5 5/1972

OTHER PUBLICATIONS

International Search Report (PCT/ISA/210) dated Nov. 3, 2016, by the European Patent Office as the International Searching Authority for International Application No. PCT/FR2016/051628.
(Continued)

*Primary Examiner* — Tony G Soohoo
(74) *Attorney, Agent, or Firm* — Buchanan Ingersoll & Rooney PC

(57) ABSTRACT

The invention relates to a system for preparing a formulation in a container, comprising an agitating device, said agitating device including means for creating a conical depression within the formulation inside said container. Said system is arranged to prepare a formulation consisting of a nail polish inside a bottle.

16 Claims, 2 Drawing Sheets

(51) Int. Cl.

| | |
|---|---|
| ***B01F 13/08*** | (2006.01) |
| ***B01F 7/00*** | (2006.01) |
| ***B01F 13/10*** | (2006.01) |
| ***B01F 9/00*** | (2006.01) |

(52) U.S. Cl.
CPC ..... *B01F 11/0054* (2013.01); *B01F 11/0062* (2013.01); *B01F 11/0068* (2013.01); *B01F 11/0082* (2013.01); *B01F 13/08* (2013.01); *B01F 13/0818* (2013.01); *B01F 13/1055* (2013.01); *B01F 13/1063* (2013.01); *B01F 2009/0058* (2013.01); *B01F 2009/0061* (2013.01); *B01F 2215/0031* (2013.01)

(58) Field of Classification Search
CPC ... B01F 2215/0031; B01F 7/0095; B01F 9/10
See application file for complete search history.

(56) References Cited

U.S. PATENT DOCUMENTS

| | | | | | |
|---|---|---|---|---|---|
| 3,045,987 | A | | 7/1962 | Cake | |
| 3,503,592 | A | * | 3/1970 | Taylor | B01F 11/0022 366/212 |
| 4,390,283 | A | * | 6/1983 | Meyer | B01F 13/0818 366/142 |
| 4,728,500 | A | | 3/1988 | Higo | |
| 4,876,069 | A | * | 10/1989 | Jochimsen | B01F 13/0818 422/73 |
| 5,352,036 | A | * | 10/1994 | Haber | A61J 1/065 206/219 |
| 6,033,574 | A | * | 3/2000 | Siddiqi | B03C 1/01 210/695 |
| 6,382,827 | B1 | * | 5/2002 | Gebrian | B01F 13/0818 366/274 |
| 6,467,946 | B1 | * | 10/2002 | Gebrian | B01F 7/005 366/273 |
| 6,500,343 | B2 | * | 12/2002 | Siddiqi | B03C 1/01 210/695 |
| 7,484,880 | B2 | * | 2/2009 | Cleveland | B01F 13/0818 366/273 |
| 10,179,899 | B2 | * | 1/2019 | Whitman | C12M 27/02 |
| 2002/0118594 | A1 | * | 8/2002 | Vellinger | B01F 13/0818 366/116 |
| 2004/0022123 | A1 | | 2/2004 | Coville et al. | |
| 2004/0165477 | A1 | | 8/2004 | Long | |
| 2016/0121281 | A1 | * | 5/2016 | Geiges | B01F 11/0082 366/273 |

OTHER PUBLICATIONS

Written Opinion (PCT/ISA/237) dated Nov. 3, 2016, by the European Patent Office as the International Searching Authority for International Application No. PCT/FR2016/051628.

* cited by examiner

SYSTEM FOR PREPARING A FORMULATION

The invention relates to the field of systems comprising agitating devices. The latter are used for applications of all types and, preferably but not exclusively, in automatic systems designed specifically to manufacture and produce cosmetic formulations, preferably but not exclusively colored, more specifically nail polishes. However, the invention cannot be limited to this sole application.

Beauty has long been a core element of people's lives. Women in Ancient Egypt would adorn themselves with artifices to improve and enhance their bodies. Passing centuries saw the development of cosmetics and other beauty products. The term "cosmetics" is understood to mean any product, substance or mixture that is designed to alter the outer skin of the human body without acting deep down. By way of example and without limitation, cosmetics are considered to be:

- Personal hygiene products, such as shampoos, soaps, shower gels, deodorants, etc.
- Sunblocks.
- Body or face-care products, such as lotions, scrubs, oils, moisturizing creams, facial masks, etc.
- Make-up products: foundations, eye shadows, eyeliners, concealers, powders, lipsticks, nail polishes, etc.

Changes in the diversity, specific nature and physicochemical properties of cosmetics have been accompanied by the development of technologies enabling the production in a broader sense of such cosmetics. Lastly, cosmetics have changed not only with the times and fashions, but also according to the raw materials available. Starting in the twentieth century, and especially the early twenty-first century, industrial production methods and research have brought a radical change in the field of cosmetics, more particularly, by the development of new ingredients and raw materials such as, by way of example and without limitation, synthetic fragrances, petroleum derivatives, synthetic surfactants and emulsion stabilizers. These new ingredients together with developments in chemical process have led to the advent of modern cosmetics.

Nowadays, all or part of cosmetic products are developed via formulation operations, i.e. industrial operations consisting in create homogeneous products that are stable over time and non-toxic by mixing together various substances and ingredients, as most cosmetics are applied to the human body. Thus, a formulation generally includes of one or more active or base compounds, such as, by way of example and without limitation, surfactants, water-soluble polymers, various additives and/or fillers, such as, by way of example but without limitation, colorants and/or pigments, fragrances, solvents, plasticizers, stabilizers and/or preservatives, etc. Formulations therefore vary with choices made by researchers during exploratory phases and/or development and manufacturing phases in addition to those made by the industry.

Unlike with other cosmetics, the twentieth and twenty-first centuries saw developments more particularly in the composition, manufacturing and handling of nail polishes. In principle, nail polishes are packaged in small bottles, most commonly known as "containers", of around three to twenty-five milliliters or even several centiliters in capacity. They are applied with a tiny brush that, in most cases, is built into an airtight cap. Only a few minutes after being applied, nail polish hardens and forms on top of nails a water-resistant and chip-resistant coating that can last for one or more days. Nail polishes are thus designed in particular to both beautify and protect nails.

As described above, the composition of a cosmetic product depends on many factors. Furthermore, and like any other cosmetic, nail polishes are no exception to this rule. There is therefore not just one formulation for every nail polish. In addition, because they are applied directly onto the human body, nail polishes must comply with a number of relatively stringent regulations and laws like any other cosmetic product. Nevertheless, some types of ingredients are generally used in nail polish compositions, such as:

- One or more film-forming agents and/or resins, i.e. synthetic or semi-synthetic polymers (such as nitrocellulose) that produce a continuous film over nails;
- Plasticizers to enhance the flexibility or even water resistance of polishes;
- Pigments and/or mother-of-pearl to color polishes;
- Solvents to disperse film-forming agents and plasticizers with pigments prior to bottling. Said solvents evaporate when said polishes are applied.

Nail polishes are sometimes referred to as suspensions, i.e. liquid products that contain particles, in the case of nail polishes containing pigments in a base, said base comprising one or more film-forming agents, one or more plasticizers and one or more solvents, divided and mixed together to form a homogeneous and lasting product that is stable for two to three years.

Throughout the years, nail polish has become a major fashion trend and, consequently, a major consumer product used by many women in particular. Every season has its particular color. However, today's women like to be able to change their nail polish whenever they feel like it. For that matter, they often own large collections of nail polish. Nevertheless, women's desires and demands are not always easily satisfied. Despite the huge palette of colors available, some women are sometimes on the lookout for a particular color of nail polish that will go with a specific item of clothing or enable them to follow a particular fashion trend, for example. In some cases, such nail polishes are not commercially available. Today, nail polishes are widely manufactured, produced and packaged on an industrial scale in large amounts using various devices installed on production and packaging lines, such as:

- Production systems, comprising specifically reactors, in the form of tanks, combined with agitating devices sized to the dimensions of the tanks and devices for dispensing the necessary ingredients, for manufacturing nail polish and able to produce several thousands of liters of said nail polish.
- Packaging systems, comprising in particular devices suitable for large-scale filling and capping of nail-polish bottles.

Thus, it is not always possible for women to obtain the specific color of nail polish they would like.

Due to increasingly fierce competition, particularly in the world of fashion, manufacturers have sought to offer new services to enable the manufacturing of nail polishes that can be "customized" to the tastes and desires of potential customers. Some have even designed systems that enable the semi-automated production of personalized nail polish. Both male and female consumers are able to select from a catalog of nearly one hundred thousand five hundred possible shades of nail polish. A compact semi-automated production system comprises a man/machine interface that may advantageously include a touch-sensitive screen for selecting a color from among the one hundred thousand five hundred shades of nail polish on offer in such a catalog. The system further comprises a plurality of dispensing devices, each dispensing device being respectively connected to an associated cartridge or tank of colored solution to dispense the correct amount of nail polish required based on the color shade selected by the consumer. Furthermore, the system may also advantageously comprise means for moving nail-polish container bottles in order to position the openings of said bottles under the various dispensing devices. Once the consumer has selected a shade of nail polish, the bottle is positioned at a specific location within the system and a code associated with the choice of said shade within the system is selected via the touch-sensitive screen. After waiting for a few minutes, the consumer obtains components in the amounts corresponding to the desired shade. Although this system is appealing and entertaining, it has a number of drawbacks. Said system does indeed make it possible to dispense basic ingredients to create customized and personalized nail polish, but it does not offer a function for agitating said basic ingredients of said nail polish. Thus, the consumer or an operator of the system must mix the ingredients by hand, sometimes by vigorously shaking the bottle once it is filled and capped. In some cases, a bead or other equivalent solid body may advantageously be inserted inside the bottle to facilitate agitation. Such agitation is tedious and difficult to reproduce because it depends on the consumer or operator doing the shaking and may take a certain amount of time. Lastly, as stated above, nail polishes are suspensions. Requiring an operator or a user to do the shaking may make it difficult to obtain a product that is both homogeneous and stable, two properties that ensure that users will have a quality product.

Still in the field of formulation, but in application with paints this time, other manufacturers have sought to develop systems and methods for producing customized or personalized paints. Like nail polishes, such paints are made from formulation operations. Additionally, some types of ingredients used to formulate paints are similar or identical to those used to formulate nail polishes, i.e.:

- One or more binders, i.e. synthetic or semi-synthetic polymers;
- Plasticizers to improve the flexibility of paints.
- Pigments to color paints;
- Solvents to disperse binders with pigments, said solvents evaporate when said paints are applied.

Depending on whether a color is selected from a sample, an idea or a color chart, the user or operator places within the automated paint production system a container, advantageously in the form of a "jar", comprising therein a base, said base comprising all the ingredients of the paint except for the pigments and colorants. Once the container is in place, the production system dispenses, via one or more suitable dispensing devices, the amounts of colorants or pigments required to obtain the desired paint shade. In principle, such colorants or pigments are advantageously in the form of powders. Once the ingredients have been dispensed, the system agitates the mixture via one or more agitating devices. Such agitating devices may in particular comprise:

- A drive system connected to a shaft, the shaft itself being connected to one or more movable agitation elements, such as propellers or turbines;
- Means for encircling the container and thus enable said container to move, such as in the form of vibrations.

Such an automated paint production system has a number of drawbacks. Firstly, said system is designed specifically for a predetermined type of formulated product and cannot be used for just any category of product. This is because paints are generally manufactured for volumes of around one liter while nail polishes are packaged in bottles of a few dozen milliliters at most. Secondly, the dispensing of powdered pigments or colorants leads to less accurate- and in some cases, approximate-dosing. Consequently, certain difficulties in obtaining the desired shades may arise. Thirdly, once paint is produced, users systematically must remix it prior to application. This is because agitation is imperfect and the formulation obtained is not always completely homogeneous.

The invention makes it possible to overcome the vast majority of drawbacks raised by the known solutions.

Among the many advantages offered by such a system for preparing a formulation according to the invention, it can be said that the system makes it possible to:

- Provide a system for preparing a formulation comprising an agitating device that makes it possible to manufacture suspensions, specifically nail polishes, that are personalized, more homogeneous and longer lasting over time.
- Provide an automated system for preparing a formulation, specifically a nail polish or any other pigmented formulation.

For this purpose, a system for preparing a formulation in a container and comprising an agitating device is provided in particular. Said agitating device comprises means for creating a conical depression within the formulation of said container and means for driving in translation, along an axis substantially parallel to the axis of rotation of the container, a solid body immersed within said container. To enable suitable and diffuse agitation along various agitation axis, in particular by preventing material deposits on the walls of the container, and obtain a homogeneous formulation, the agitating device of a system according to the invention comprises means for radially guiding the solid body inside the container.

In a preferred but not exclusive embodiment, the means for creating a conical depression of the agitating device of a system according to the invention may comprise means for driving in rotation the container along an axis substantially parallel to the axis of revolution of said container.

As an alternative or in addition, the means for creating a conical depression of the agitating device of a system according to the invention may comprise means for driving in rotation said solid body immersed inside the container along an axis substantially parallel to the axis of revolution of the container.

Preferably but not exclusively, when the immersed body is made of a ferromagnetic or paramagnetic material, the means for driving in rotation said body of said agitating device may comprise a magnet rotatably mounted about an axis substantially parallel to the axis of revolution of the container.

Similarly, preferably but not exclusively, when the immersed body is made of a ferromagnetic or paramagnetic material, the means for driving in translation said body of said agitating device may comprise a magnet translatably mounted along an axis substantially parallel to the axis of revolution of the container.

Likewise, preferably but not exclusively, when the immersed body is made of a ferromagnetic or paramagnetic material, the means for radially guiding said body may comprise a magnet translatably mounted along a variable radius of a virtual circle substantially concentric with the base of the container.

In addition, the means for radially guiding said body of an agitating device may additionally consist in arranging the magnet rotatably mounted along a variable radius of a virtual circle substantially concentric with the base of the container.

Preferably, to ensure optimal agitation of the formulation, the radius may be less than or equal to that of the inner base of the container.

In an advantageous embodiment, said radius may be predetermined by a pneumatic shaft cooperating with the magnet.

Advantageously but not exclusively, the translation of the magnet may be predetermined by a pneumatic shaft cooperating with the magnet.

To enable the various components of the formulation to be distributed inside the container and provide an all-in-one automated machine, a system for preparing a formulation according to the invention may further comprise means for dispensing components of said formulation.

Preferably but not exclusively, in order to facilitate and optimize dispensing of the components, the dispensing means of a system according to the invention may comprise one or more electrovalves, each electrovalve being in fluid communication, respectively, with a tank.

As an alternative or in addition, to avoid all intervention by a user or operator of said system while preparing a formulation, said system may further comprise a processing unit. Thus, the means for creating a conical depression, the rotation driving means, the translation driving means and/or the radial guiding means may cooperate with and/or comprise one or more electrically controlled actuators, said control signal or said control signals being produced by the processing unit.

As an alternative or in addition, the processing unit of a system according to the invention may be arranged to generate control signals usable by the dispensing means.

Preferably but not exclusively, the processing unit of a system according to the invention may cooperate with or comprise storage means, said storage means comprising instructions, executable or interpretable by the processing unit, the interpretation or execution thereof causing control signals to be generated for the actuators and/or dispensing means of said system.

In a preferred but not exclusive embodiment, a system according to the invention may be arranged to prepare a formulation consisting of a nail polish.

Other features and benefits will become clearer as the reader proceeds through the following description and reviews the accompanying figures, amongst which:

Figure 1:
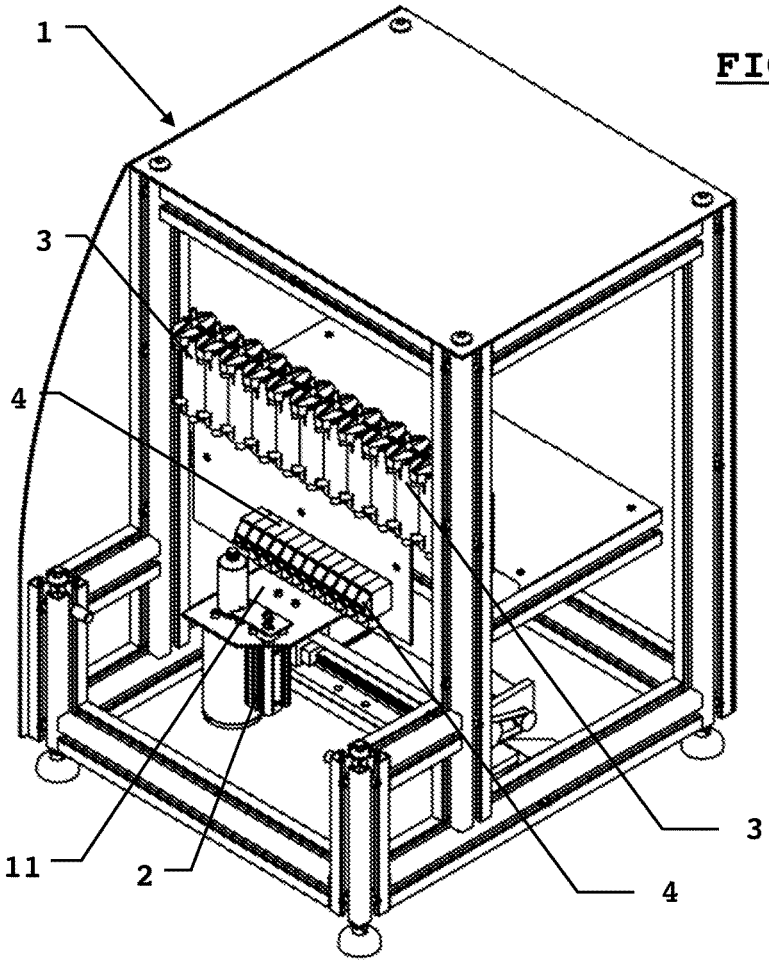
FIGS. 1 and 2 show two detailed views of one embodiment of a system for preparing a formulation inside a container according to the invention.
Figure 2:
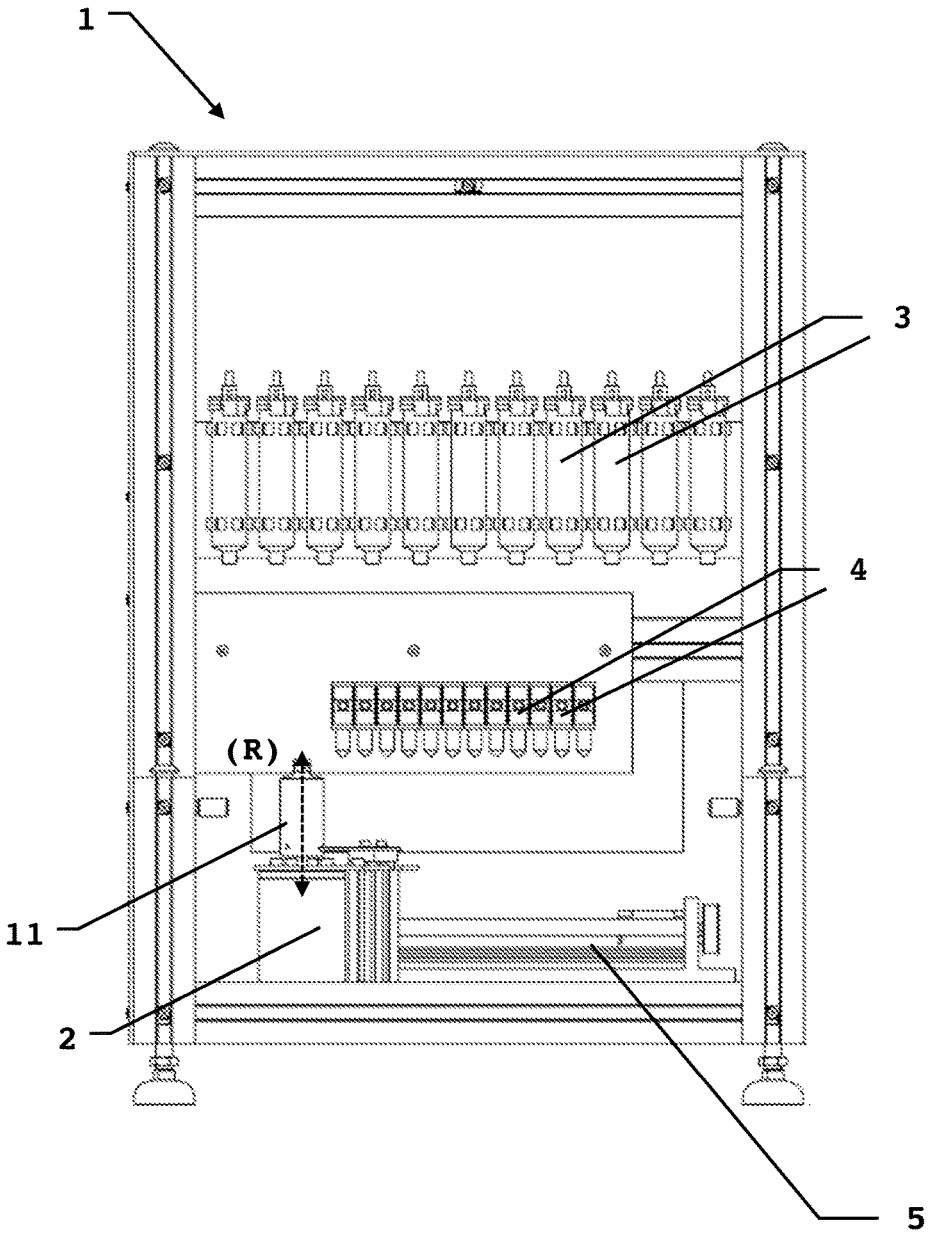

FIGS. 1 and 2 show views of one embodiment of a system for manufacturing and producing a formulation in a container according to the invention. In this preferred but not exclusive embodiment, such a system is arranged to automatically manufacture a formulation consisting of a nail polish within the bottle of same. However, the invention cannot be limited to this sole embodiment. The invention provides that a system for preparing a formulation may be used for any kind of colored formulation manufactured in containers of a few milliliters or even several centiliters.

In the sense of the invention, "formulation" is understood to mean any product obtained from a formulation operation, i.e. any mixture of various raw materials or components, and which leads to obtaining a "formulated" product that is stable and homogeneous and which has properties that correspond to predetermined specifications. In principle, a formulation includes at least one dispersed phase and one dispersion phase. By way of example and without limitation, the invention provides that the following be considered as formulations:

- Emulsions: mixture of immiscible liquids, one of which forms droplets in suspension;
- Foams: dispersion of gas bubbles in a liquid phase;
- Suspensions: dispersion of fine solid particles in a liquid phase;
- Gels: three-dimensional network of solid particles diluted and/or dispersed in a fluid;

In addition, in the sense of the invention, "container" is understood to mean any receptacle provided to contain, package and store the formulation. Such a container must be suitable for ensuring the stability of the formulation throughout the period after said formulation is manufactured. The invention therefore provides that the formulation be manufactured and packaged in the same container. By way of example and without limitation, a container, in the sense of the invention, may be a bottle, a jar, a vial or any other equivalent means. Preferably, said container may consist of a bottle 11, the axis of revolution (R) thereof being defined as the axis passing through the center of the section of the opening 11*o* of said bottle 11 and the center of the section of the base 11*b* of the same bottle 11. By way of example and without limitation, as described in connection with FIGS. 1 to 3, such a bottle 11 advantageously has a neck, i.e. a narrow portion near the opening 11*o*, the section thereof being less than the section of the base 11*b* of the same bottle 11.

As stated above, the bottle 11 advantageously has an opening 11*o* through which the components of the formulation may be added. Throughout the formulation preparation method via a system according to the invention, the container, specifically the bottle 11, will advantageously be maintained open, then sealed at the end of said manufacturing method.

In FIGS. 1 and 2, a system 1 for preparing a formulation in a container according to the invention advantageously comprises an agitating device 2. As stated above, a formulation consists of a mixture of at least two initially immiscible components. The mixing step, in the formulation preparation method, is thus essential to obtain said formulation. An agitating device thus makes it possible to provide such a step, i.e. ensure that the various components in the formulation, be they solid, liquid or gaseous, are brought in contact with one another in order to obtain a stable and homogeneous mixture or at least bring the phases into intimate contact. To achieve an adequate formulation, i.e. one that meets precise specifications, the agitating device 2 depends on a number of physicochemical factors and/or parameters, i.e. the type of agitating device to be selected and the determination of the operating conditions.

Figure 3:
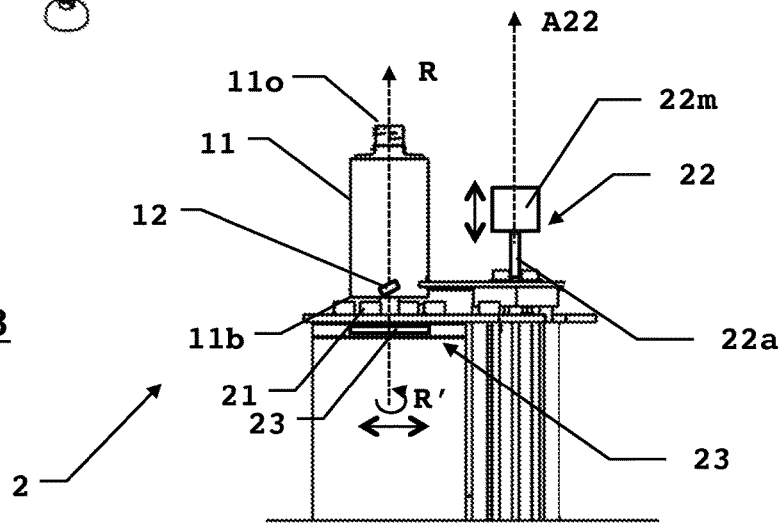
FIG. 3 shows a close-up view of an agitating device of a system for preparing a formulation according to the invention.

FIG. 3 shows an example of an agitating device 2 of a system 1 for preparing a formulation inside a container, i.e. the bottle 11.

Whatever the desired result, every mixing operation is defined by three features:

- A container, i.e. the bottle 11 in FIG. 3;
- A fluid or liquid, that may advantageously be a component of the formulation to be prepared, advantageously in movement;
- A feature creating an alteration or change in movement of the fluid.

Lastly, the mixture defines the operation dispersing a component of the formulation within another component of the latter, via a forced movement advantageously achieved using a mechanical means.

To enable suitable agitation and obtain a homogeneous formulation, the agitating device 2 of a system 1 according to the invention includes means for creating a conical depression within the formulation inside said container, i.e. the bottle 11. Such a conical depression, also referred to as a "vortex", consists of a swirl flow of said formulation wherein the particles of the components of the formulation rotate about an instantaneous axis to create a circulatory movement of said particles and ultimately of the flow of the components, thus homogenizing the mixture and, consequently, the formulation.

In a preferred but not exclusive embodiment, in order to create a depression within the flow of material, the means for creating a conical depression of the agitating device 2 of a system according to the invention may comprise means 21 for driving in rotation the bottle 11 along an axis substantially parallel to the axis of revolution R of the bottle 11. Indeed, when said bottle thus rotated is positioned such that the axis of revolution of the neck thereof is substantially combined with the ejection axis of a component, via a dispensing means, said component is collected within the bottle but without said component spattering the inner wall of the neck of said bottle. Preferably but not exclusively, the axis of rotation may be combined with the axis of revolution R of said bottle 11, thus optimally mixing the formulation. The bottle 11, thus rotating on itself at a predetermined speed, advantageously controlled, makes it possible to create a conical depression of the formulation contained therein. As an alternative or in addition, the axis of rotation may optionally be altered during the formulation preparation method. Indeed, depending on the progress of said method, it may optionally be relevant to "offset the rotation" of said bottle, such that said axis of rotation is no longer combined with the axis of revolution of the bottle. The latter thus describes a substantially cylindrical path, when a dispensing means delivers a component, said component is not projected substantially along the axis of rotation of the bottle, but may cover the inner wall of the bottle, or at least the inner wall of the neck. Thus, for example, it is possible to coat the neck of the bottle 11 with a basic component of the formulation and subsequently prevent any colored component from being deposited on the neck of said bottle 11, said deposit may alter the color of the formulation, if it turns out that the ejection direction or the diffusion of said component is insufficiently combined with the axis of revolution of the bottle and covers the inner wall of the neck. Thereafter, the bottle 11 may advantageously be positioned to be rotated along the axis of revolution thereof. Therefore, the agitating device of a system according to the invention may comprise means for driving in a radial translation the bottle 11. Such translation driving means may optionally be combined and consist of a single physical entity with the means 21 for driving in rotation the bottle 11. For simplification purposes, said translation means are not shown in FIG. 3. In FIG. 3, said means 21 for driving in rotation the bottle 11 are arranged under said bottle 11 and may advantageously comprise means for grasping and maintaining the bottle. Such means 21 comprise a bottle rotation driving system to enable the rotation movements to be transmitted. By way of example and without limitation, such a rotation system may consist of a mechanical system of friction wheels, belts and pulleys, gears by means of toothed wheels. Additionally, such a driving system may be controlled electrically. In a preferred but not exclusive application mode, the bottle 11 may advantageously be rotated continuously throughout the formulation preparation method.

Also, as an alternative or in addition, the agitating device of a system for preparing a formulation according to the invention may comprise means for tilting and/or righting the axis of revolution of the bottle 11, or more generally the container 11, to an angle predetermined relative to the normal axis of a holder of said bottle passing through the center of gravity thereof, advantageously but not exclusively between forty-five degrees negative (−45) and forty-five degrees positive (+45). Like the means for driving in a radial translation the bottle, such means for tilting and/or righting the bottle make it possible to correctly distribute the components of the formulation and thereby improve agitation of the formulation. Said tilting and/or righting means may optionally be combined with the means for driving in rotation said bottle 11.

As an alternative or in addition, to create such a conical depression within the flow of material, the means for creating a conical depression of the agitating device 2 of a system 1 according to the invention may comprise means for rotating a solid body 12 immersed inside the bottle 11 along an axis substantially parallel to the axis of revolution of the container. Preferably but not exclusively, the axis of rotation may be combined with the axis of revolution R of said bottle 11, thus optimally mixing the formulation, the solid body 12, rotating thus on itself at a predetermined, or even controlled, speed, within the formulation. The solid body creates a relative motion of the particles of the components of the formulation and thereby creates a conical depression of the formulation contained therein. Furthermore, the solid body 12 is arranged and sized to be contained inside the bottle and immersed in the formulation. Advantageously but not exclusively, the solid body 12 may be in the form of a bead. Preferably, the solid body 12 may be in the form of a cylinder or bar to improve dispersion of the swirl movement and, consequently, the conical depression within the formulation.

Additionally, the solid body 12 is made of one or more materials that are chemically inert with respect to the components of said formulation. By way of example and without limitation, said solid body 12 may be made of polytetrafluoroethylene (also known as PTFE or the brand name Teflon®).

Preferably but not exclusively, the immersed solid body 12 may be made of a ferromagnetic or paramagnetic material. "Ferromagnetic material" is understood to mean any material, body or substance capable of being magnetized by an external magnetic field, said magnetization persisting in the absence, or following removal, of said external magnetic field. "Paramagnetic material" is understood to mean any material or substance that has no spontaneous magnetization, but which is capable, under the effect of an external magnetic field, of acquiring magnetization directed in the same direction as the excitation magnetic field. Thus, the magnetization of a paramagnetic material dissipates in the absence, or following removal, of such an external magnetic field. In this particular case, magnetization is not an intrinsic property of the paramagnetic material but rather a behavior that changes depending on externally applied conditions.

When the solid body 12 is made of such ferromagnetic and/or paramagnetic materials, the means for driving in rotation said body 12 of said agitating device 2 may comprise a magnet rotatably mounted about an axis R' substantially parallel to the axis of revolution R of the bottle 11. As stated above, preferably but not exclusively, the axis of rotation R' may be combined with the axis of revolution R of said bottle 11, thus optimally mixing the formulation. Additionally, the axis of rotation of the solid body 12 is combined with the axis of rotation of the magnet providing optimal rotation of the solid body 12. To rotate the magnet, the latter may advantageously cooperate, along various types of mechanical connections, by way of example and without limitation, an embedded connection, with a magnet rotation driving system to transmit rotation movements to said magnet. By way of example and without limitation, such a rotation driving system may consist of a mechanical system of friction wheels, belts and pulleys, gears by means of toothed wheels. Additionally, such a rotation driving system may be controlled electrically. In addition, in the sense of the invention, a magnet consists of a body, a substance or a device, generally made of a hard magnetic material, naturally generating a magnetic field and being able to attract other devices or objects, i.e. the immersed solid body 12, advantageously made of a ferromagnetic or paramagnetic material. Once the solid body 12 is "attracted" by the magnet, said solid body 12 positions itself parallel to the field lines. Thus, when the magnet is rotated by a suitable drive system at a predetermined speed, said solid body 12 is, due to magnetism, also rotated at the same predetermined speed. As an alternative, such a magnet may be substituted or replaced by an electromagnet. Such an electromagnet consists of a device that produces a magnetic field when said device is powered with electricity. Generally, said electromagnet consists of a coil, also referred to as a solenoid, and a part made of a ferromagnetic material, commonly referred to as a "magnetic circuit". The electromagnet is thus a magnet "controlled" by an electric current and thereby makes it possible to produce a controlled and controllable magnetic field for a given region of space. The use of such an electromagnet therefore guarantees better control of the solid body 12 and thus of agitation, a key step in preparing formulations.

As an alternative or in addition, to ensure agitation that is more evenly distributed inside the bottle 11 and consequently homogenization of the formulation prepared inside said bottle, the agitating device 2 of a system 1 according to the invention may comprise means for driving in translation, along an axis A22 substantially parallel to the axis of revolution of the bottle 11, the solid body 12. The movement of the solid body 12 from the base 11*b* toward the opening 11*o* of the bottle 11 allows dispersing the particles of the components in the formulation in a second direction. The combination of means for driving in rotation the formulation and means for driving in translation the solid body thus promotes contact between the various components of the formulation, thereby optimizing homogenization of the mixture of the constituents and lastly the formulation preparation operation. Specifically, the solid body 12 may then be placed in contact with the walls of the bottle 11, rub against said walls and thus prevent components from being deposited on and/or against said walls. Such deposits indeed are unacceptable because they hinder homogenization of the mixture. In the particular case of pigmented formulations, by way of example and without limitation, nail polishes, obtaining a desired shade for such a formulation essentially depends on correct mixing of the various components in the formulation. The presence of deposits on the walls may in such case alter the shade obtained for the prepared formulation. In an advantageous but not exclusive embodiment, in order to prevent deposits from forming on the walls of the bottle 11 and specifically on the neck of said bottle 11, the solid body 12 may advantageously have a shape arranged and/or suited to move around inside the bottle 11, and optionally be in contact with the inner wall of the bottle and more particularly at a shoulder formed by the neck. Thus, it is possible to prevent deposits of material on said neck, without the solid body 12 falling out of said bottle. A block-shaped solid body 12 may be selected instead of a spherical body for example.

Preferably but not exclusively, as stated above, the immersed solid body 12 may be made of a ferromagnetic or paramagnetic material. When said immersed solid body 12 is made of a ferromagnetic or paramagnetic material, the means 22 for driving in translation said body 12 of said agitating device 2 may comprise a magnet 22*m* translatably mounted along an axis A22 substantially parallel to the axis R of revolution of the bottle 11. To enable translation of said magnet 22*m*, the means 22 for driving in translation said body 12 may further comprise a translation driving system, said system cooperating with the magnet along a suitable mechanical connection, preferably but not exclusively a embedded connection. In addition, like the magnet comprised in the means for driving in rotation the solid body 12, said magnet 22*m* consists of a body, a substance or a device, generally made of a hard magnetic material, naturally generating a magnetic field and being able to attract other devices or objects, i.e. the immersed solid body 12, advantageously made of a ferromagnetic or paramagnetic material. Once the solid body 12 is "attracted" by the magnet 22*m*, said solid body 12 positions itself parallel to the field lines. Thus, when the magnet 22*m* is translated by a suitable translation driving system at a predetermined speed, said solid body 12 is, due to magnetism, also translated at the same predetermined speed. As an alternative, such a magnet may be substituted or replaced by an electromagnet. As stated above, the use of such an electromagnet therefore guarantees better control of the solid body 12 and thus of agitation, a key step in preparing formulations.

As an alternative or in addition, to ensure agitation and consequently homogenization of a formulation, the agitating device 2 of a system 1 according to the invention may comprise means 23 for radially guiding the solid body 12 inside the bottle 11. The movement of the solid body 12 from the wall toward the axis of revolution of the bottle 11 allows dispersing the particles of the components in the formulation in a third direction. The combination of means for driving in rotation the formulation and means for driving in translation a solid body 12 and/or means for radially guiding a solid body 12 thus promotes contact between the various components of the formulation, thereby optimizing homogenization of the mixture of the constituents and lastly the formulation preparation operation. Furthermore, the solid body 12 may then be placed in contact with the wall of the base 11*b* of the bottle 11, rub against said wall and thus prevent components from being deposited on and/or against said wall. Such deposits indeed are unacceptable because they hinder homogenization of the mixture. In the particular case of pigmented formulations, by way of example and without limitation, nail polishes, obtaining a desired shade for such a formulation essentially depends on correct mixing of the various components in the formulation. The presence of deposits on the wall of the base 11*b* may in such case alter the shade obtained for the prepared formulation. The solid body 12, immersed inside the bottle 11, optionally near the base 11*b* of said bottle 11, is guided from the inner wall of the bottle 11 toward the axis of revolution R of the bottle 11. The distance between a point along the inner wall of the bottle 11 and said axis of revolution R of the bottle defines a radius along a plane substantially horizontal and parallel to the base 11*b* of the bottle 11. Such guiding thus ensures propagation of the agitation phenomenon throughout the volume of the formulation, thereby ensuring improved dispersion of the particles of the components throughout the volume.

Preferably but not exclusively, as stated above, the immersed solid body 12 may be made of a ferromagnetic or paramagnetic material. When said immersed solid body 12 is made of a ferromagnetic or paramagnetic material, the means 23 for radially guiding said body may comprise a magnet 23*m* translatably mounted along a variable radius of a virtual circle substantially concentric with the base 11*b* of the bottle 11. In addition, the bottle 11 may, in a non-exclusive example, be cylindrical. In this case, the center of the virtual circle may advantageously be in an axis substantially combined with the axis of revolution R of the bottle 11. Preferably, to ensure optimal agitation of the formulation, the radius may be less than or equal to that of the inner base 11*b* of the bottle 11. Indeed, the solid body 12 being contained inside the bottle 11, it is guided inside said bottle 11.

To enable translation of said magnet 23*m*, the means 23 for driving in translation said body 12 along a radius may further comprise a translation drying system, said system cooperating with the magnet along a suitable mechanical connection, preferably but not exclusively a embedded connection. Said magnet 23*m* thus may be mounted on a rotating arm of fixed or variable length, or on a disc comprising a housing translatable along a radius. As an alternative, said magnet 23*m* may advantageously be mounted on a rotating arm connected to a disc comprising said translatable arm. Such arms or discs may make up the translation driving system, as described above. In another advantageous embodiment, said translation driving system may advantageously comprise an electrically operated pneumatic shaft cooperating with the magnet 23*m*, said pneumatic shaft being advantageously arranged to determine the radius controlling the radial translation of the solid body 12. As an alternative or in addition, by way of example and without limitation, such a translation system may comprise a cylinder, a helical spring, a rack-and-pinion or roller-drive system, a screw-nut system, a cam or any other equivalent means able to provide said translation function.

Advantageously but not exclusively, in the same way, the means 22 for driving in translation said body 12 along an axis A22 may further comprise translation driving system. In an advantageous embodiment, said translation driving system may advantageously comprise an electrically operated pneumatic shaft 22*a* cooperating with the magnet 22*m*, said pneumatic shaft being advantageously arranged to determine the translation of the translation of the solid body 12 along axis A22. As an alternative or in addition, by way of example and without limitation, such a translation driving system may comprise a cylinder, a helical spring, a rack-and-pinion or roller-drive system, a screw-nut system, a cam or any other equivalent means able to provide said translation function.

In addition, as described above, said magnet 23*m* consists of a body, a substance or a device, generally made of a hard magnetic material, naturally generating a magnetic field and being able to attract other devices or objects, i.e. the immersed solid body 12, advantageously made of a ferromagnetic or paramagnetic material. Once the solid body 12 is "attracted" by the magnet 23*m*, said solid body 12 positions itself parallel to the field lines. Thus, when the magnet 23*m* is driven in translation by a suitable translation driving system at a predetermined speed, said solid body 12 is, due to magnetism, also driven in translation at the same predetermined speed. Regardless of whether the bottle 11 or the magnet 23*m* is rotatably movable, the solid body 12 describes turbulent paths of variable "radii" in given transverse planes, substantially parallel to the base 11*b* of the bottle 11. As an alternative, such a magnet may be substituted or replaced by an electromagnet. As stated above, the use of such an electromagnet therefore guarantees better control of the solid body 12 and thus of agitation, a key step in preparing formulations.

In addition, the means 23 for radially guiding said body 12 of an agitating device 2 may additionally consist in arranging the magnet rotatably mounted along a variable radius of a virtual circle substantially concentric with the base of the bottle 11. Hence, the agitating device 2 is simplified because the number of features making it up is reduced. Indeed, the rotatably mounted magnet and the magnet 23*m* translatably mounted along a variable radius of a virtual circle substantially concentric with the base 11*b* of the bottle 11 may consist of a single entity. When this entity is an electromagnet, the directions of movement of the solid body 12 may be defined depending on the controlled electric control.

To enable the various components of the formulation to be distributed inside the bottle 11, the system according to the invention may further comprise means 4 for dispensing components to prepare said formulation. Such dispensing means 4 make it possible to limit, and in some cases, even eliminate, all intervention by a user or operator of a system 1 for preparing a formulation according to the invention. Additionally, the dispensing means 4 may also deliver a specific and predetermined amount of each component. Indeed, each component has specific physicochemical properties that must be taken into account when preparing a formulation, such as, by way of example and without limitation, viscosity, density, solubility, temperature for liquids and pressure for gases, particle size of the components, etc. All these parameters must also be considered when determining the mixing or agitation speed to ensure that an optimal homogeneous mixture is obtained. Additionally, said dispensing means 4 may also cooperate with or comprise means for controlling the temperature of each component. To increase the dosing accuracy in order to obtain the desired shade, as an alternative or in addition, the means for dispensing 4 each component may also cooperate, respectively, with means for controlling the pressure. Preferably but not exclusively, the components of the formulation to be prepared are advantageously in liquid form. In order to facilitate and optimize dispensing of the components, the dispensing means 4 of a preparation system 1 according to the invention may comprise one or more electrovalves, each electrovalve being in fluid communication, respectively, with a tank 3. Indeed, the amounts of components used for preparation are around a few microliters. The electrovalves therefore are particularly suitable for distributing the respective desired amounts of the components of the formulation and thus make it possible to prepare said formulation with great accuracy. However, the invention cannot be limited to using solenoid valves as dispensing means. Any device or system that is able to regulate a flow and/or distribute a predetermined amount of a component may also be used. Advantageously but not exclusively, such fluid communication may be provided via one or more channels or microchannels, advantageously flexible or rigid, suitable for conveying various components of the formulation, particularly at the physicochemical conditions, and specifically pressure or flow rate. The channels may be replaced by any equivalent means able to provide a substantially identical function. Each component of said formulation may advantageously be contained or stored inside a tank 3, advantageously suited to the physicochemical parameters of said component. A system 1 for preparing a formulation according to the invention thus may cooperate with or comprise therein one or more cartridges or tanks 3. Furthermore, preferably but not exclusively, the dispensing means may be arranged and/or suited so that:

- The ejection direction of the basic component may, in conjunction with the agitating device, coat the inner wall of the neck;
- The ejection direction of the other colored components is substantially combined with the axis of revolution of the neck and is at least not in contact with the inner wall of the neck.

In addition, in FIGS. 1 and 2, the system for preparing a formulation within a container, specifically a bottle 11, may advantageously comprise means 5 for moving the container or bottle 11. Such movement means 5 are advantageously arranged and/or suited to move the bottle 11 and stop the same, if necessary, under the dispensing means 4, so as to ultimately enable the components of the formulation to be distributed. Such means may, advantageously but not exclusively, consist of one or more belt conveyors, a stepper worm drive or any other equivalent device and cooperate with the agitating device 2.

The invention has been described in the context of the preferred application thereof, i.e. the preparation of nail polish. However, as stated above, the invention cannot be limited to just this application. Depending on the desired cosmetic to be prepared, in some cases it may be necessary to evaporate solvents, compounds that are essential for preparing the formulations of said cosmetics. By way of example and without limitation, such cosmetics may advantageously be eye shadows or foundations in powder form. The invention thus provides that a system for preparing a formulation according to the invention may comprise means for heating and/or cooling the container and ultimately the formulation, and ultimately enabling said solvents to be evaporated.

The various means, specifically but not exclusively 22, 23, of the agitating device 2, the dispensing means 4, the temperature control means and/or the means 5 for moving the bottle 11 each require a control to be actuated. Manual actuation is a possibility, but it would be long and tedious to carry out. As an alternative or in addition, to avoid all intervention by a user or an operator of said system while preparing a formulation and thus provide an automated system for preparing a formulation, specifically nail polish, suitable and usable by the greatest number of people, a system 1 for preparing a formulation according to the invention may further comprise a processing unit (not shown in FIGS. 1 and 2). Such a processing unit, advantageously but not exclusively in the form of one or more microprocessors or microcontrollers, may thus generate one or more control signals to trigger the operation of the actuator or actuators of the means for creating a conical depression, the rotation driving means, the translation driving means, the radial guiding means, the bottle-moving bottle and/or the temperature control means, the actuator or actuators being advantageously electrically controlled. As an alternative or in addition, the processing unit of a system according to the invention may also be arranged to generate control signals usable by the dispensing means 4 so the said unit determines the relevant dispensing sequence, i.e. distribution of the respective amounts of the components depending on the selected shade.

Preferably but not exclusively, the processing unit of a system according to the invention may cooperate with or comprise storage means (not shown in FIGS. 1 and 2), said storage means comprising instructions, executable or interpretable by the processing unit, the interpretation or execution thereof causing control signals to be generated for the actuators and/or dispensing means of said system. The storage means may advantageously comprise a program memory, arranged to store the instructions from one or more programs designed specifically to implement the control sequences in order to prepare a formulation. The control signals may advantageously be transmitted to the actuators over wires or, in the case of wireless communication, via radio frequency, via light, etc. In the latter case, generating such control signals consists in elaborating and transmitting such control signals.

Depending on the formulation in question, the processing unit is suited per program to create control sequences that are transmitted, respectively, to the actuators of the means for creating a conical depression, of the rotation driving means, of the translation driving means, of the radial guiding means, of the bottle-moving means, of the dispensing means and/or temperature control means, said sequences being optimized and/or designed specifically for the formulation. Thus, said processing unit may transmit two separate control sequences for two different formulations. Within the same control sequence, the rotation speed of the means for creating a conical depression may differ for two different formulations: the configuration thus differs depending on the formulation. All this may thus be configured or set by modifying the program loaded into the memory of the storage means of the processing unit. The system may therefore elaborate multiple "recipes" depending on the formulation or the desired shade. By way of example and without limitation, according to a predetermined application mode, such a sequence may comprise a control signal for actuating the means for continuously creating a conical depression, throughout the preparation method and one or more control signals for actuating the means for radially guiding the solid body each time a dispensing means is used, i.e. after each injection and/or addition of an amount, even minimal, of components. The invention further provides that said means for creating a conical depression may control the rotation speed of said bottle during the preparation method.

To enable an operator and/or user to cooperate with the system 1 for preparing a formulation in order to configure same, fine-tune settings and/or select a formulation from a list of available formulations, said system 1 may comprise a man/machine interface (not shown in FIGS. 1 and 2). As an alternative, said interface may be remote, cooperate with such a system 1, consist of a keyboard and/or a computer screen, a smartphone or other tablet. Said man/machine interface may also comprise means for capturing an image of a pattern and derive therefrom the primary shade (any code coming from a determined or predetermined reference system used to identify various color shades) of said pattern, in order to select a desired formulation.

In a preferred but not exclusive embodiment, a system according to the invention may be arranged to prepare a formulation consisting of a nail polish.

The invention has been described during the operation thereof in relation to automatic systems designed specifically to prepare and produce cosmetic formulations, particularly colored formulations, specifically nail polishes, to mix said nail polishes during on-site preparation thereof. It may also be used for any type of cosmetic formulation requiring the aid of a specific agitating device and microfluidic dispensing means, such as foundations, lip glosses and eye shadows. Furthermore, the invention cannot be limited to the field of cosmetics, but may be used in any other field of formulation, such as that of acrylic paints.

Other changes may be considered without falling out of the scope of the present invention as defined by the claims appended hereto.

The invention claimed is:

1. System for preparing a formulation in a container, comprising an agitating device, said agitating device comprising means for creating a conical depression within the formulation inside said container and means for driving in translation, along an axis substantially parallel to the axis of revolution of the container, a solid body immersed inside said container, wherein the agitating device comprises means for radially guiding the solid body inside the container.

2. System according to claim 1, wherein the means for creating a conical depression comprise means for driving in rotation the container along an axis substantially parallel to the axis of revolution of the container.

3. System according to claim 1, wherein the means for creating a conical depression comprise means for driving in rotation said immersed solid body inside the container along an axis substantially parallel to the axis of revolution of the container.

4. System according to claim 3, the immersed body being made of a ferromagnetic or paramagnetic material, wherein the means for driving in rotation said body comprise a magnet rotatably mounted about an axis substantially parallel to the axis of revolution of the container.

5. System according to claim 4, wherein the translation of the magnet is predetermined by a pneumatic shaft cooperating with the magnet.

6. System according to claim 1, the immersed body being made of a ferromagnetic or paramagnetic material, wherein the means for driving in translation said body comprise a magnet translatably mounted along an axis substantially parallel to the axis of revolution of the container.

7. System according to claim 1, the immersed body being made of a ferromagnetic or paramagnetic material, wherein the means for radially guiding said body comprise a magnet translatably mounted along a variable radius of a virtual circle substantially concentric with the base of the container.

8. System according to claim 7, wherein the means for radially guiding said body further consist in arranging the magnet rotatably mounted along a variable radius of a virtual circle substantially concentric with the base of the container, and wherein the means for driving in rotation said body comprise a magnet rotatably mounted about an axis substantially parallel to the axis of revolution of the container.

9. System according to claim 7, wherein the radius is less or equal than that of the inner base of the container.

10. System according to claim 9, wherein said radius is predetermined by a pneumatic shaft cooperating with the magnet.

11. System according to claim 1, further comprising means for dispensing components of said formulation.

12. System according to claim 11, wherein the dispensing means comprise one or more electrovalves, each electrovalve being in fluid communication, respectively, with a tank.

13. System according to claim 1, further comprising a processing unit, wherein the means for creating a conical depression, the rotation driving means, the translation driving means and/or the radial guiding means cooperate with and/or comprise one or more electrically controlled actuators, said control signal or said control signals being generated by the processing unit.

14. System according to claim 13, wherein the processing unit is arranged to generate control signals usable by a means for dispensing components of said formulation.

15. System according to claim 13, wherein the processing unit cooperates with or comprises storage means, said memory-storage means comprising instructions, executable or interpretable by the processing unit, the interpretation or execution thereof causing control signals to be elaborated for the actuators and/or a dispensing means of said system.

16. System according to claim 1, wherein said system is arranged to prepare a formulation consisting of a nail polish.

* * * * *